US011370218B2

(12) United States Patent
Yoshida et al.

(10) Patent No.: US 11,370,218 B2
(45) Date of Patent: Jun. 28, 2022

(54) INKJET PRINT APPARATUS

(71) Applicant: Samsung Display Co., LTD., Yongin-si (KR)

(72) Inventors: Futoshi Yoshida, Yongin-si (KR); Cheong Wan Min, Yongin-si (KR); Min A Han, Yongin-si (KR); Jae Bum Pahk, Yongin-si (KR); Jeong Ho Yi, Yongin-si (KR); Heung Cheol Jeong, Yongin-si (KR); Myung Soo Huh, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/150,521

(22) Filed: Jan. 15, 2021

(65) Prior Publication Data

US 2021/0300026 A1 Sep. 30, 2021

(30) Foreign Application Priority Data

Mar. 27, 2020 (KR) ..... 10-2020-0037786

(51) Int. Cl.
*B41J 2/045* (2006.01)
*B41J 2/175* (2006.01)
(Continued)

(52) U.S. Cl.
CPC ..... *B41J 2/04515* (2013.01); *B41J 2/14088* (2013.01); *B41J 2/17566* (2013.01); *B41J 2/17596* (2013.01); *B41J 2/18* (2013.01)

(58) Field of Classification Search
CPC ..... B41J 2/04515; B41J 2/14088; B41J 2/17596; B41J 2/17566; B41J 2/175; B41J 2/18; B41J 2/195; B41J 2/17513
See application file for complete search history.

(56) References Cited

U.S. PATENT DOCUMENTS 7,258,426 B2 * 8/2007 Furukawa ..... B41J 2/06 347/55
8,408,684 B2 4/2013 Lecheheb et al.
(Continued)

FOREIGN PATENT DOCUMENTS

JP 2003-19790 1/2003
JP 2006-334967 12/2006
(Continued)

*Primary Examiner* — An H Do
(74) *Attorney, Agent, or Firm* — Kile Park Reed & Houtteman PLLC

(57) ABSTRACT

An inkjet print apparatus includes a print head discharging ink onto a substrate, the print head including a first heater; a reservoir storing the ink; a first pipe supplying the ink to the reservoir; a second pipe collecting surplus ink; a mixing unit located on the first pipe and mixing the ink; a pump located on the second pipe and pressurizing and supplying the surplus ink to the reservoir; a temperature sensor located between the mixing unit and the print head and sensing a temperature of the ink; and a controller controlling a temperature of at least one of the first heater and the second heater in response to information received from the temperature sensor. The print head includes a heat insulator blocking heat emitted from the first heater between the substrate and the first heater.

24 Claims, 16 Drawing Sheets

(51) Int. Cl.
*B41J 2/18* (2006.01)
*B41J 2/14* (2006.01)

(56) References Cited

U.S. PATENT DOCUMENTS

| | | | | |
|---|---|---|---|---|
| 9,045,822 | B2 * | 6/2015 | Kang | C23C 14/12 |
| 10,022,978 | B2 * | 7/2018 | Ohtsu | B41J 2/17596 |

FOREIGN PATENT DOCUMENTS

| | | |
|---|---|---|
| JP | 4108367 | 6/2008 |
| JP | 4984959 | 7/2012 |
| JP | 6607488 | 11/2019 |
| KR | 10-1332188 | 12/2013 |

* cited by examiner

INKJET PRINT APPARATUS

CROSS-REFERENCE TO RELATED APPLICATION(S)

The application claims priority to Korean patent application 10-2020-0037786, filed on Mar. 27, 2020, and all the benefits accruing therefrom under 35 U.S.C. § 119, the content of which in its entirety is herein incorporated by reference.

BACKGROUND

1. Technical Field

The disclosure generally relates to an inkjet print apparatus.

2. Description of the Related Art

As the information society has been developed, demands for display devices for displaying images have increased in various forms. For example, the display devices have been applied to various electronic devices such as smartphones, tablet PCs, digital cameras, laptop computers, navigation systems, monitors, and TVs. The display devices may be flat panel display devices such as a liquid crystal display device, a field emission display device, an organic light emitting display device, and a quantum dot light emitting display device.

An inkjet printing process of forming a thin film having a desired shape by spraying ink onto a surface of a target object may be used in a thin film manufacturing process such as a process of forming a light emitting layer of the organic light emitting display device. An inkjet print apparatus may print a thin film having a desired pattern on a substrate by generating each ink droplet in a nozzle of a print head and discharging the ink droplet at a predetermined position of the substrate as a target object.

The inkjet print apparatus may use a discontinuous inkjet printing method and a continuous inkjet printing method, wherein in the discontinuous inkjet printing method, an ink droplet is generated in the print head as needed and wherein in the continuous inkjet printing method ink droplets are continuously generated in the print head, only selected ink droplets among the ink droplets are discharged toward the substrate, and ink droplets that have not been discharged are re-circulated to an ink supply.

In the inkjet print apparatus using the continuous inkjet printing method, in case that the ink that has not been discharge is re-circulated, the temperature and viscosity of the ink may be changed, and therefore, the discharge amount of the ink may not be uniform.

SUMMARY

Embodiments of the invention provide an inkjet print apparatus capable of uniformly maintaining a discharge amount of ink.

Embodiments also provide an inkjet print apparatus capable of printing a thin film having a pattern at a desired position on a substrate by uniformly maintaining a temperature distribution of the substrate.

Embodiments also provide an inkjet print apparatus capable of uniformly maintaining a concentration of ink.

In accordance with an aspect of the disclosure, an inkjet print apparatus may include a print head discharging ink onto a substrate, the print head including a first heater heating the ink; a reservoir storing the ink; a first pipe supplying the ink to the reservoir from the print head; a second pipe collecting surplus ink to the reservoir from the print head; a mixing unit located on the first pipe, the mixing unit including a second heater heating the ink, the mixing unit mixing the ink; a pump located on the second pipe, the pump pressurizing the surplus ink and supplying the surplus ink to the reservoir; a temperature sensor located on the first pipe between the mixing unit and the print head, the temperature sensor sensing a temperature of the ink; and a controller controlling a temperature of at least one of the first heater and the second heater in response to information received from the temperature sensor.

The print head may comprise a heat insulator blocking heat emitted from the first heater between the substrate and the first heater.

The print head may comprise a nozzle discharging the ink. The heat insulator may comprise an opening overlapping the nozzle in a thickness direction.

The inkjet print apparatus may comprise a cooling unit located on the second pipe between the pump and the reservoir, the cooling unit cooling the surplus ink.

The cooling unit may comprise a thermoelement.

The cooling unit may maintain a temperature of the surplus ink to be equal to a temperature of the ink initially supplied to the print head from the reservoir.

The controller may maintain a temperature of the print head to be equal to that of the ink heated by the second heater, through the first heater.

The second heater may comprise a thermoelement or a silicon rubber heater.

The mixing unit may comprise a static mixer or a mixer using a surface acoustic wave (SAW).

The inkjet print apparatus may comprise a first pressure sensor located on the first pipe between the mixing unit and the print head, the first pressure sensor sensing a pressure of the ink.

In case that the pressure sensed by the first pressure sensor is higher than a predetermined pressure, the controller may heat the ink to a temperature corresponding to the predetermined pressure, through the first heater.

The inkjet print apparatus may comprise a second pressure sensor located on the second pipe between the print head and the pump, the second pressure sensor sensing a pressure of the surplus ink.

In case that a difference between the pressure sensed by the first pressure sensor and the pressure sensed by the second pressure sensor exceeds a predetermined range, the controller may heat the ink in proportion to the difference between the pressures, through the first heater.

In accordance with another aspect of the disclosure, an inkjet print apparatus may include a print head discharging ink; a solvent circulating unit supplying a solvent comprised in the ink to the print head; and a particle circulating unit supplying a particle-containing solution comprised in the ink to the print head.

The solvent circulating unit may comprise a first reservoir storing the solvent; a first pipe supplying the solvent to the print head from the first reservoir; and a second pipe collecting a surplus solvent comprised in surplus ink to the first reservoir from the print head.

The particle circulating unit may comprise a particle supply unit supplying the particle-containing solution to the first pipe; a second reservoir located on the second pipe, the second reservoir storing a surplus ink; a third pipe collecting a surplus particle-containing solution separated from the surplus solvent of the surplus ink to the particle supply unit from the second reservoir; a concentration sensor located on the first pipe between the particle supply unit and the print head, the concentration sensor sensing a concentration of the ink; and a supply controller controlling a supply amount of the particle-containing solution in response to information received from the concentration sensor.

The particle circulation unit may comprise a third reservoir storing the collected surplus particle-containing solution, and a first pump supplying the surplus particle-containing solution to the first pipe from the third reservoir.

In case that the concentration of the ink, which is sensed by the concentration sensor, is lower than a predetermined concentration, the supply controller may increase the supply amount of the particle-containing solution through the first pump.

The inkjet print apparatus may further comprise a second pump located on the third pipe, the second pump pressurizing the surplus particle-containing solution and supplying the surplus particle-containing solution to the particle supply unit.

The second reservoir may separate the surplus ink into the surplus solvent and the surplus particle-containing solution by using a surface acoustic wave (SAW).

The print head may comprise a first heater heating the ink.

The inkjet print apparatus may further comprise a mixing unit located on the first pipe between the particle supply unit and the concentration sensor. The mixing unit may comprise a second heater heating the ink and mixes the solvent and the particle-containing solution.

The inkjet print apparatus may further comprise a temperature sensor located on the first pipe between the mixing unit and the print head, the temperature sensor sensing a temperature of the ink.

The inkjet print apparatus may comprise a controller controlling a temperature of the print head to be equal to that of the ink heated by the second heater, through the first heater.

The mixing unit may comprise a static mixer or a mixer using a surface acoustic wave (SAW).

The inkjet print apparatus may comprise a cooling unit located on the second pipe between the second reservoir and the third reservoir, the cooling unit cooling the surplus solvent.

The cooling unit may maintain a temperature of the surplus solvent to be equal to a temperature of the solvent initially supplied to the print head from the first reservoir.

BRIEF DESCRIPTION OF THE DRAWINGS

Some embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION OF THE EMBODIMENTS

Figure 1:
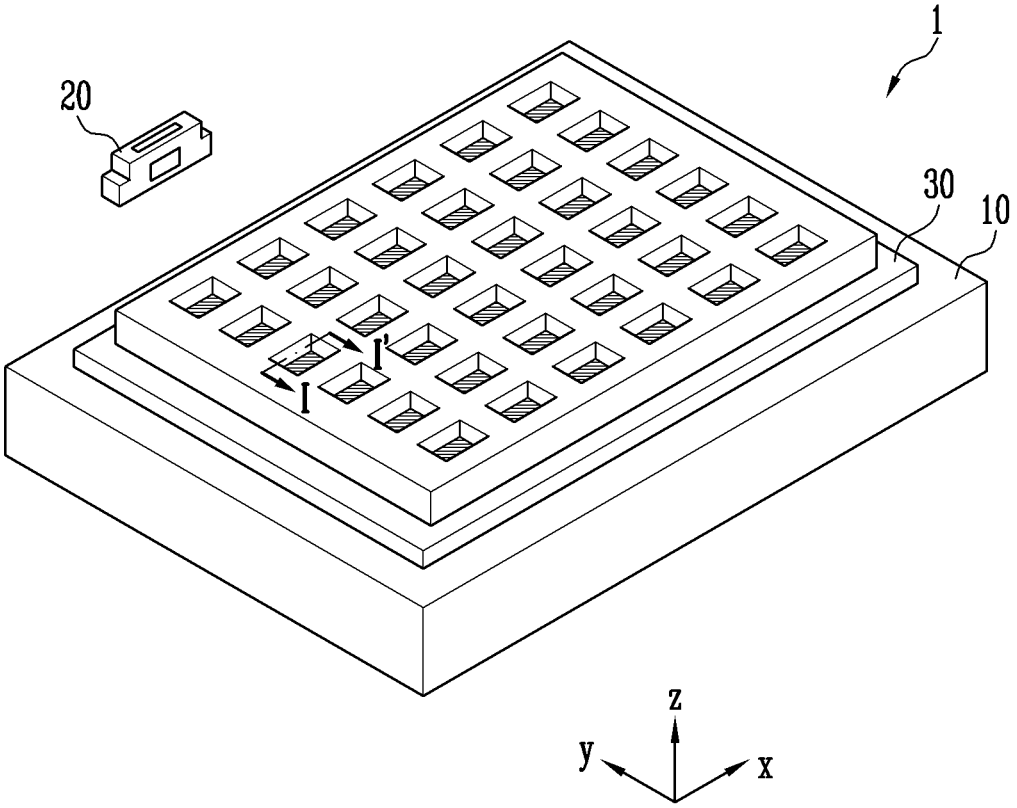
FIG. 1 is a schematic perspective view illustrating an inkjet print apparatus in accordance with an embodiment of the disclosure.

The effects and characteristics of the disclosure and a method of achieving the effects and characteristics will be clear by referring to the embodiments described below in detail together with the accompanying drawings. However, the disclosure is not limited to the embodiments disclosed herein but may be implemented in various forms. The embodiments are provided by way of example only so that a person of ordinary skilled in the art can fully understand the features in the disclosure and the scope thereof. Therefore, the disclosure can be defined by the scope of the appended claims.

Like reference numerals generally denote like elements throughout the specification. The shapes, sizes, ratios, angles, numbers, and the like illustrated in the accompanying drawings for describing the various embodiments of the disclosure are merely examples, and the disclosure is not limited thereto.

Although the terms "first," "second," and the like are used for describing various components, these components are not confined by these terms. These terms are merely used for distinguishing one component from the other components. Therefore, a first component may be a second component or vice versa according to the technical concepts of the disclosure.

Respective characteristics of several embodiments of the disclosure may be partially or entirely coupled or combined, and technically and variously connected and driven enough for those skilled in the art to fully understand, and respective embodiments may be independently carried out, and implemented together according to an associated relation.

Hereinafter, embodiments of the disclosure will be described in more detail with reference to the accompanying drawings.

Figure 2:
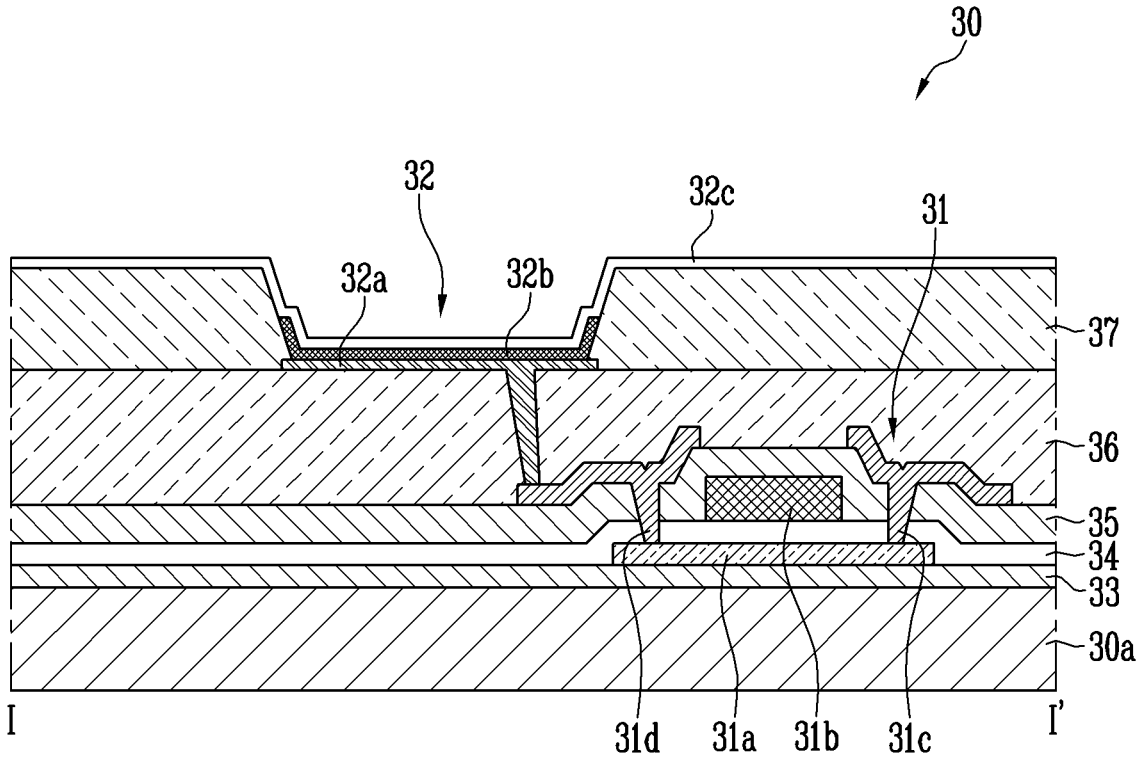
FIG. 2 is a schematic sectional view of a substrate taken along line I-I' shown in FIG. 1.

FIG. 1 is a schematic perspective view illustrating an inkjet print apparatus in accordance with an embodiment of the disclosure. FIG. 2 is a schematic cross-sectional view of a substrate taken along line I-I' shown in FIG. 1.

Referring to FIGS. 1 and 2, the inkjet print apparatus 1 in accordance with the embodiment of the disclosure may comprise a stage 10, a print head 20 which discharges ink (e.g., organic light emitting ink) on a substrate 30, and a driving unit (not shown) which moves the stage 10 or the print head 20.

The stage 10 supports the substrate 30 and may be formed of a rigid material. However, the material of the stage 10 is not limited thereto. In an embodiment, the stage 10 may have a rectangular parallelepiped shape, but the shape of the stage 10 is not limited thereto.

The substrate 30 may be located on the stage 10. The substrate 30 may comprise a base substrate, a thin film transistor, an insulating layer, or the like. The base substrate may be made of a material such as transparent glass, a plastic sheet, or silicon, but the material of the base substrate is not limited thereto.

The substrate 30 may be a unit display substrate and may be a mother substrate before the substrate 30 is cut and divided into unit display substrates. The substrate 30 may be a sheet of substrate but may comprise stacked substrates.

As shown in FIG. 2, in the substrate 30 in accordance with an embodiment of the disclosure, a buffer layer 33 may be formed on a base substrate 30*a*, and a thin film transistor 31 and an organic light emitting device 32 may be formed on the buffer layer 33.

The thin film transistor 31 may have an active layer 31*a*, a gate insulating layer 34 formed to cover the active layer 31*a*, and a gate electrode 31*b* on the top of the gate insulating layer 34.

An interlayer insulating layer 35 may be formed to cover or overlap the gate electrode 31*b*, and a source electrode 31*c* and a drain electrode 31*d* may be formed on the top of the interlayer insulating layer 35.

The source electrode 31*c* and the drain electrode 31*d* may be in contact with a source region and a drain region of the active layer 31*a* through contact holes formed in the gate insulating layer 34 and the interlayer insulating layer 35, respectively.

A pixel electrode 32*a* of the organic light emitting device 32 may be electrically connected to the drain electrode 31*d*. The pixel electrode 32*a* is formed on the top of a planarization layer 36, and a pixel defining layer 37 defining a sub-pixel region is formed over the pixel electrode 32*a*. A light emitting layer 32*b* of the organic light emitting device 32 is formed in an opening of the pixel defining layer 37, and a counter electrode 32*c* is deposited on the top of the light emitting layer 32*b* and the pixel defining layer 37. For example, the opening surrounded by the pixel defining layer 37 becomes a region of a sub-pixel such as a red pixel (R), a green pixel (G), and a blue pixel (B), and the light emitting layer 32*b* of a corresponding color is formed in the opening. One sub pixel is illustrated herein, but multiple sub-pixels may be arranged in row and column directions in an actual display unit.

Sub-pixels may have a rectangular shape. The sub-pixels may be arranged in a matrix form of n×m (n and m are integers of 1 or greater). In an embodiment shown in FIG. 1, in case that the row direction is a y-direction, and the column direction is an x-direction, sub-pixels may be arranged in a matrix form of 6×6 on the substrate 30. However, the arrangement of the sub-pixels shown in FIG. 1 is merely illustrative, and a greater number of sub-pixels than those shown in FIG. 1 may be arranged on the substrate 30. Sub-pixels may be arranged not only in a matrix form but also in various forms such as a stripe form and a pentile form.

Thin films of the organic light emitting display device may be formed by printing them with the above-described print head 20. For example, the light emitting layer 32*b* having a desired pattern may be formed by spraying the ink at a position corresponding to the light emitting layer 32*b*.

The inkjet print apparatus 1 will be described in detail with reference to FIGS. 3 to 9.

Figure 3:
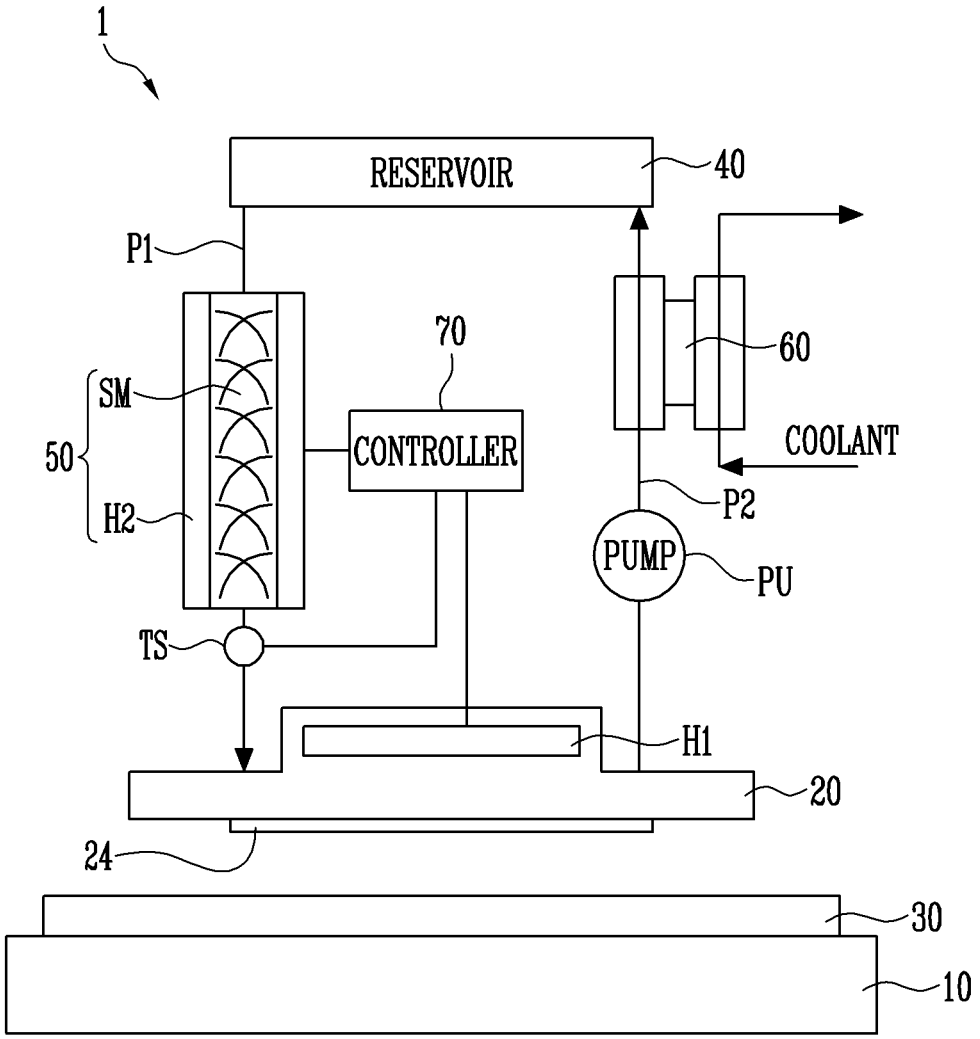
FIG. 3 is a view schematically illustrating an inkjet print apparatus in accordance with an embodiment of the disclosure.
Figure 4:
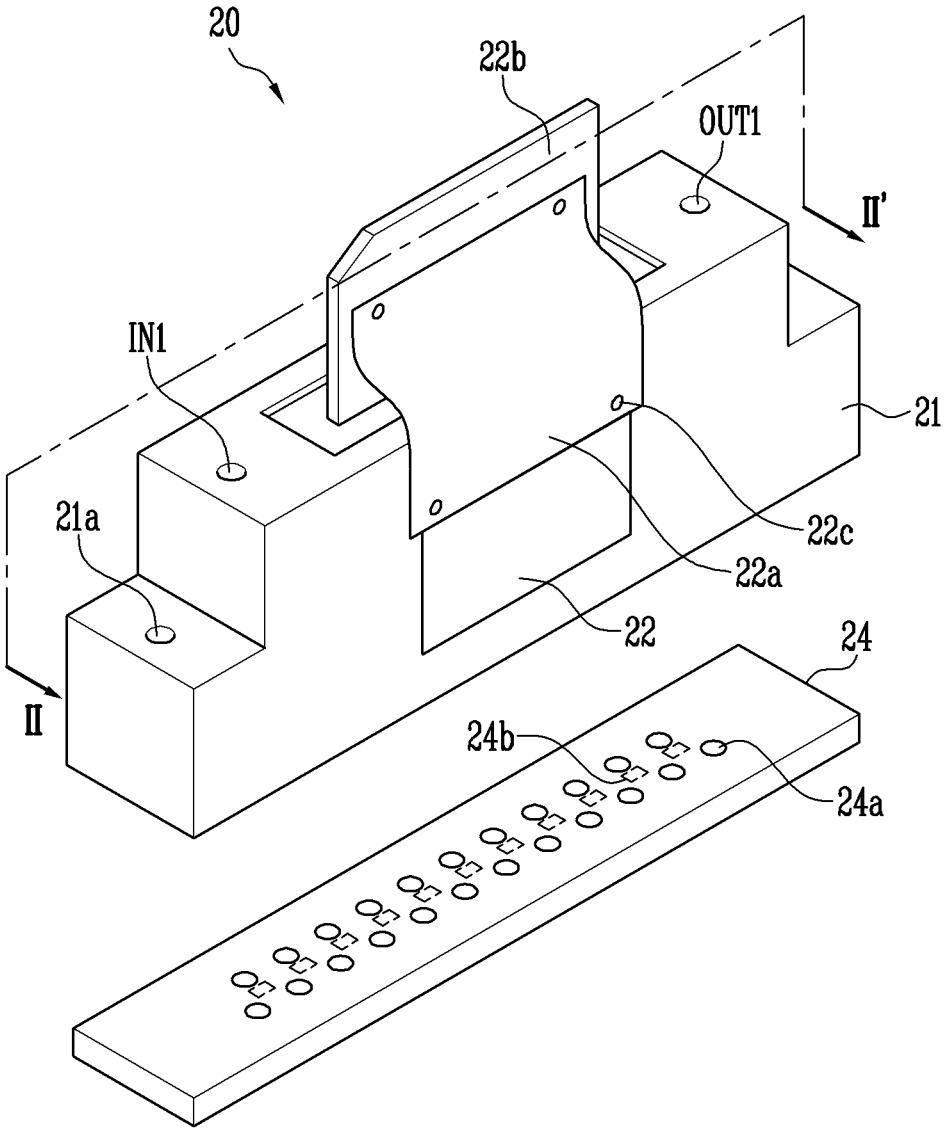
FIG. 4 is a schematic perspective view of a print head in accordance with an embodiment of the disclosure.
Figure 5:
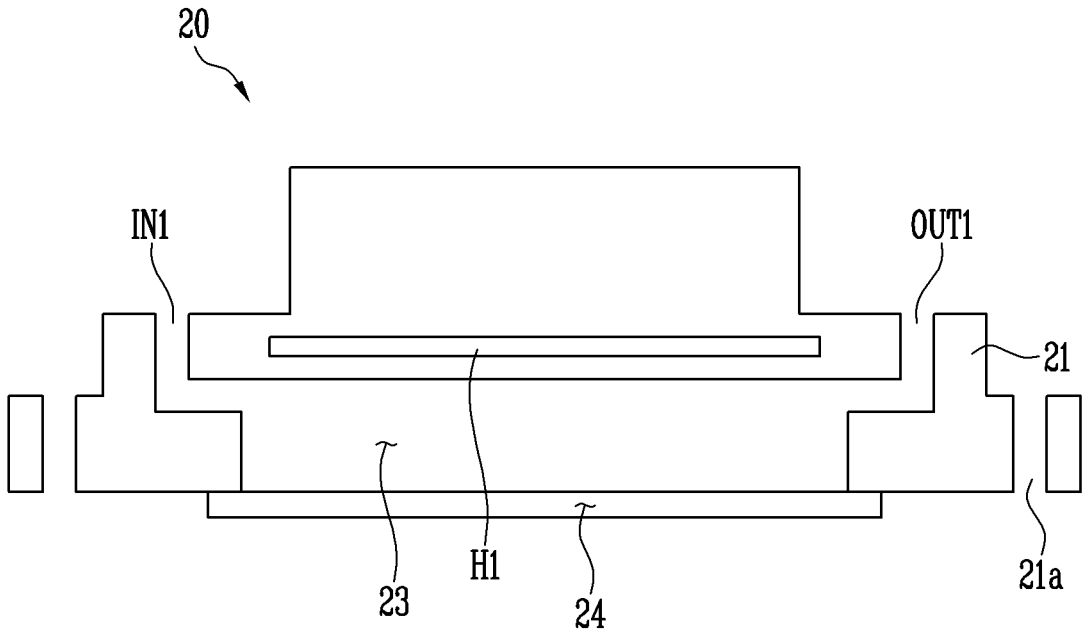
FIG. 5 is a schematic sectional view of the print head taken along line II-IF shown in FIG. 4.
Figure 6:
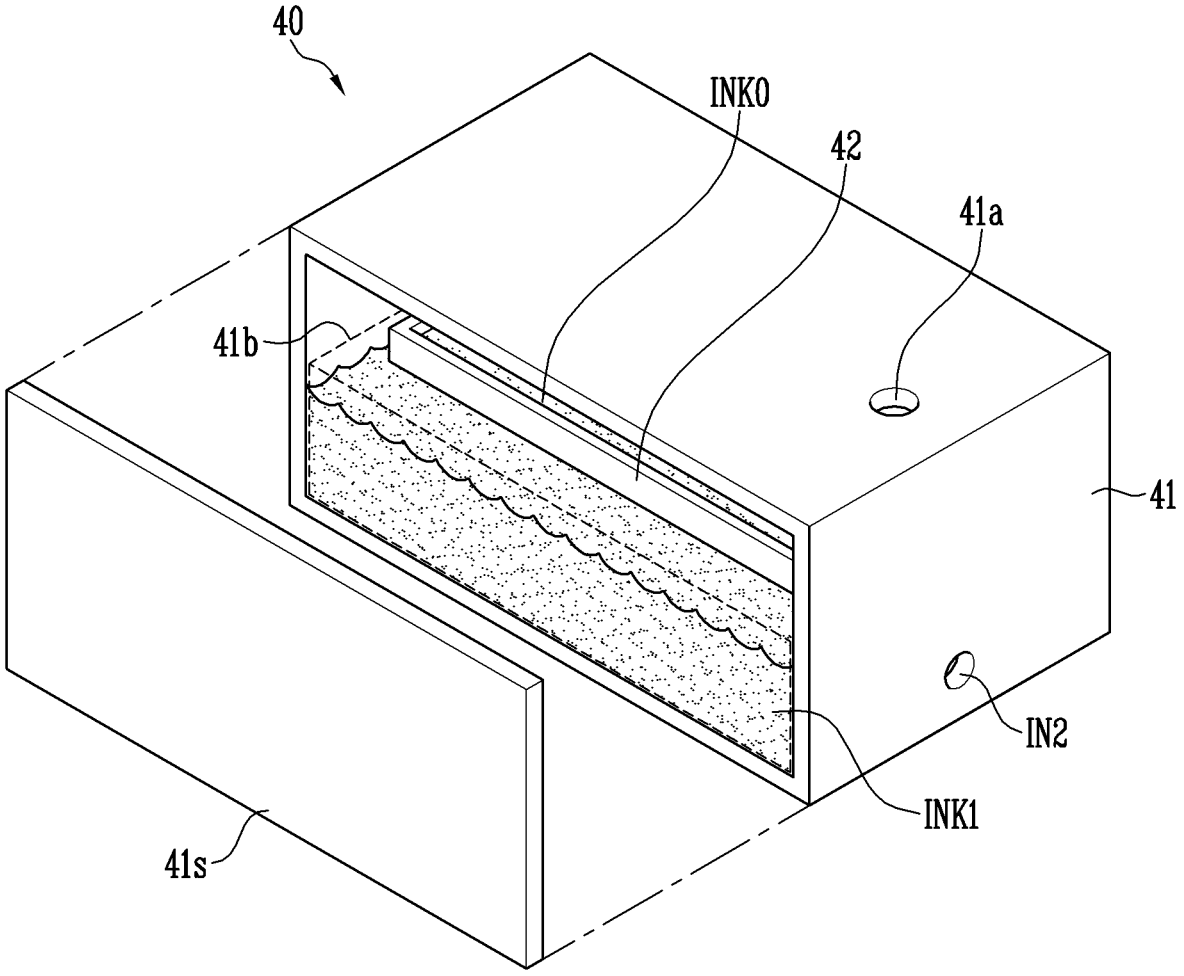
FIG. 6 is a schematic perspective view a reservoir in accordance with an embodiment of the disclosure.
Figure 7:
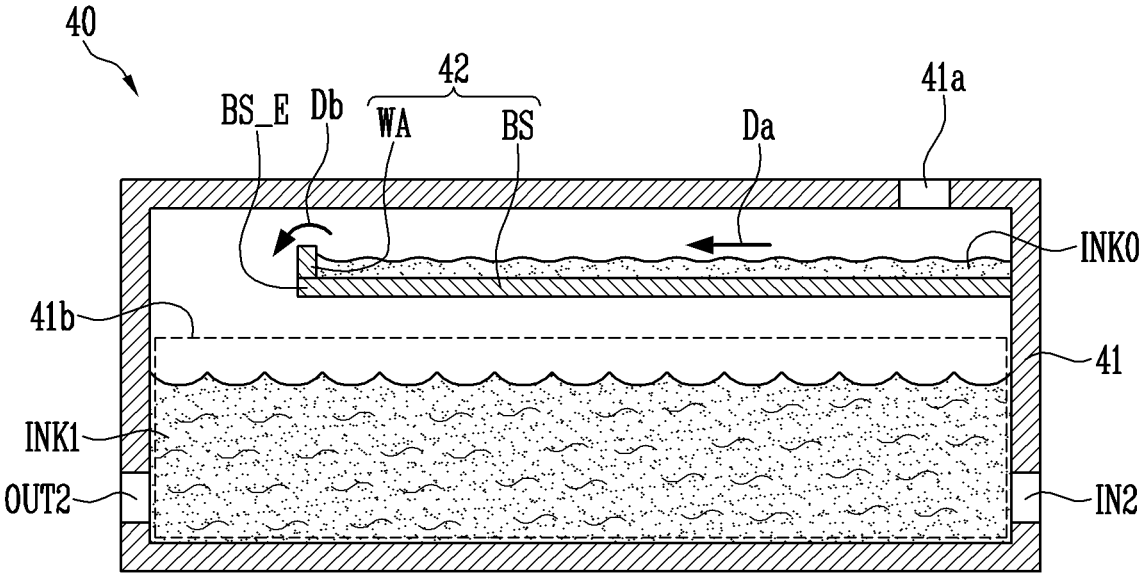
FIG. 7 is a schematic sectional view of the reservoir shown in FIG. 6.
Figure 8:
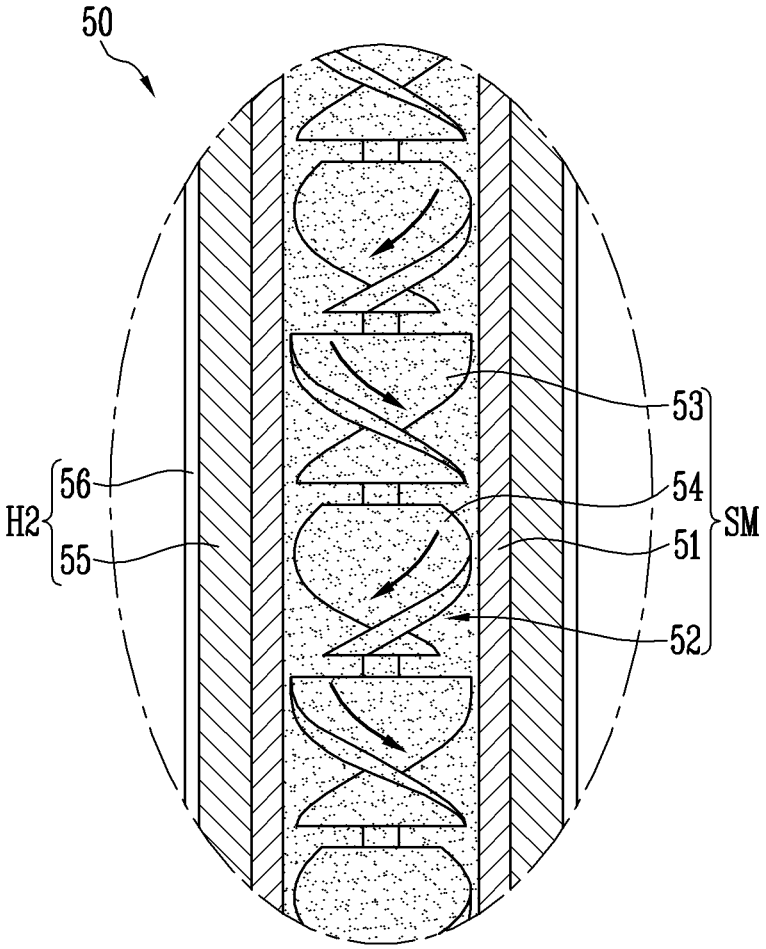
FIG. 8 is a schematic sectional view illustrating a mixing unit in accordance with an embodiment of the disclosure.
Figure 9:
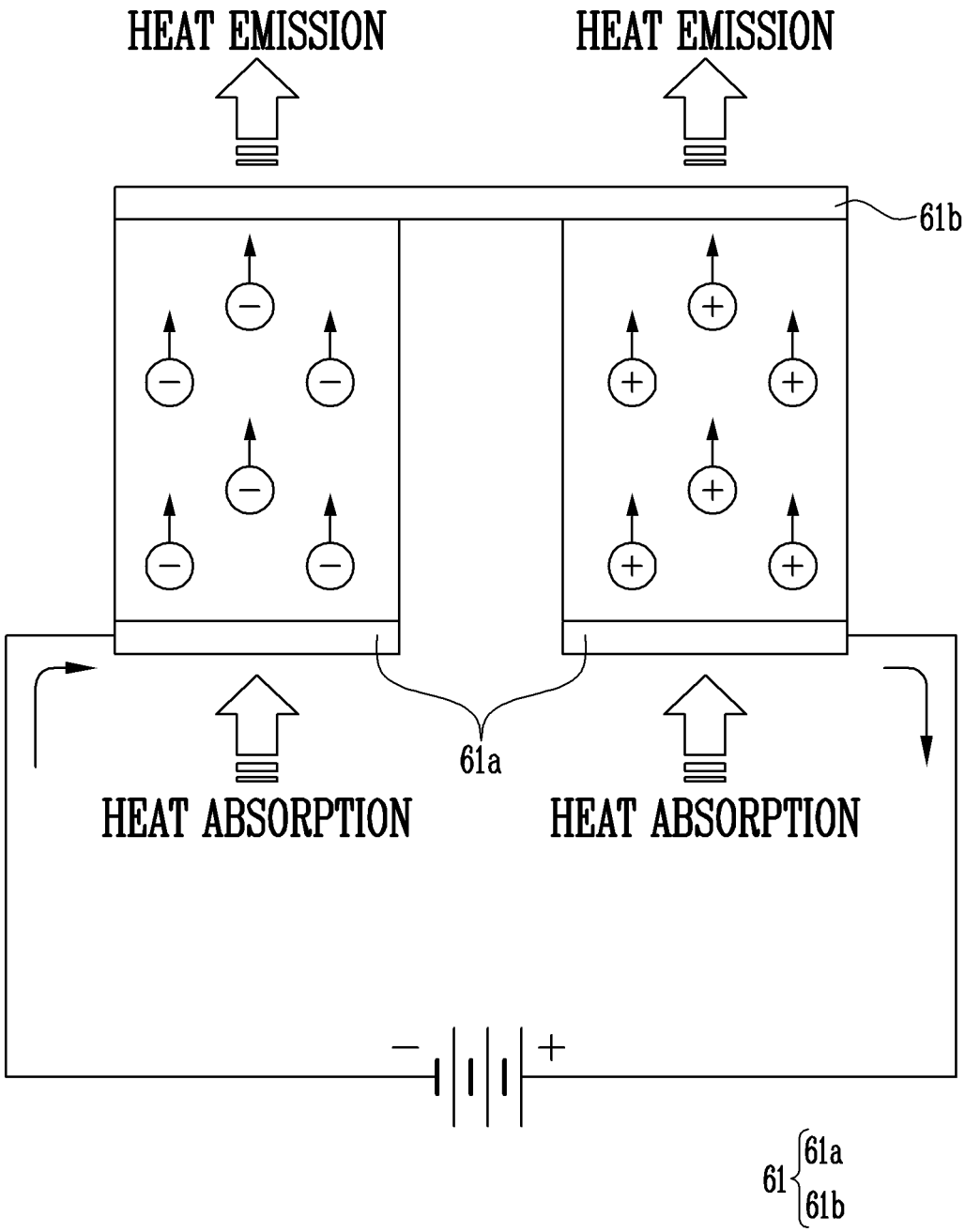
FIG. 9 is a view schematically illustrating a cooling unit in accordance with an embodiment of the disclosure.

FIG. 3 is a view schematically illustrating an inkjet print apparatus in accordance with an embodiment of the disclosure. FIG. 4 is a schematic perspective view of a print head in accordance with an embodiment of the disclosure. FIG. 5 is a schematic sectional view of the print head taken along line II-IF shown in FIG. 4. FIG. 6 is a schematic perspective view a reservoir in accordance with an embodiment of the disclosure. FIG. 7 is a schematic cross-sectional view of the reservoir shown in FIG. 6. FIG. 8 is a schematic cross-sectional view illustrating a mixing unit in accordance with an embodiment of the disclosure. FIG. 9 is a view schematically illustrating a cooling unit in accordance with an embodiment of the disclosure.

Referring to FIGS. 3 to 9, the inkjet print apparatus may comprise a print head 20, a reservoir 40, a first pipe P1, a second pipe P2, a mixing unit 50, a pump PU, a cooling unit 60, a temperature sensor TS, and a controller 70.

In accordance with an embodiment of the disclosure, the print head 20 may discharge ink on a substrate 30.

Referring to FIGS. 4 and 5, the print head 20 in accordance with this embodiment may comprise a main body 21 serving as a frame of the print head 20, a driving part 22 located at a side surface of the main body 21, an ink storage 23, a nozzle 24, and a first heater H1.

The main body 21 may serve as the frame of the print head 20. The main body 21 may have various shapes. The main body 21 may have a quadrangular pillar shape.

The main body 21 may comprise an inlet IN1 located at one side of the main body 21 and an ink outlet OUT1 located at another side of the main body 21. The inlet IN1 and the ink outlet OUT1 may be formed by forming holes in the main body 21. Various kinds of ink compositions, detergents, and the like may be injected through the inlet IN1. The ink composition, the detergent, and the like may be discharged through the ink outlet OUT1. For example, the ink stored in the reservoir 40 (see FIG. 6) may be supplied to the ink storage 23 through the inlet IN1, ink droplets may be continuously generated in the nozzle 24, only selected ink droplets among the ink droplets may be discharged toward the substrate 30, and ink droplets which have not been discharged may be collected to the reservoir 40 through the ink outlet OUT1, so that the ink may be re-circulated.

The main body 21 may comprise a coupling hole 21*a* for coupling the main body 21 to the nozzle 24. The coupling hole 21*a* may be located at both sides of the main body 21.

The driving part 22 may be located at both sides of the main body 21, to drive the nozzle 24 by applying power to the nozzle 24. The driving part 22 may be electrically connected to a printed circuit board 22*b* through a flexible circuit board 22*a*.

Although not shown in the drawings, the driving part 22 may comprise a circuit on a silicon substrate, into which transistors, a resistor, a capacitor, or the like are integrated. The driving part 22 may spray the ink by applying power to the nozzle 24.

The flexible circuit board 22*a* may be located at the outside of the main body 21 and may be electrically connected to the driving part 22. The flexible circuit board 22*a* may apply power for discharging the ink to the driving part 22.

The flexible circuit board 22*a* is a substrate in which a circuit is formed on a flexible insulating film and may use a heat-resistance plastic film such as polyester or polyimide as a flexible material. The flexible circuit board 22*a* may be provided in plurality as needed.

The printed circuit board 22*b* may generate a signal for driving the driving part 22. The printed circuit board 22*b* may be located at an upper portion of the print head 20 to be electrically connected to the driving part 22 through the flexible circuit board 22*a*.

Through connection elements 22*c*, the driving part 22 and the flexible circuit board 22*a* may be electrically connected to each other, and the flexible circuit board 22*a* and the printed circuit board 22*b* may be electrically connected to each other. For example, the connection elements 22*c* may be made of a conductive material such as copper (Cu) or aluminum (Al).

The main body 21 may comprise the ink storage 23 which stores the ink supplied from the inlet IN1.

The ink storage 23 may be located at the inside of the main body 21 and may be located on the bottom of the inlet IN1. The ink storage 23 may be supplied with the ink from the inlet IN1 to allow the ink to flow toward the nozzle 24.

The main body 21 may comprise the nozzle 24 which is supplied with the ink from the ink storage 23 to discharge the ink to the outside of the main body 21. The nozzle 24 may be located on the bottom of the ink storage 23.

Although not shown in the drawings, dispersion holes (not shown) for dispersing the ink discharged from the nozzle 24 may be formed at a lower surface of the main body 21. For example, 128 or 256 dispersion holes may be formed.

The nozzle 24 may be supplied with the ink from the print head 20 to discharge the ink having a desired size. The nozzle 24 may be located at a lower portion of the print head 20.

Nozzle upper holes 24*a* may be formed at an upper surface of the nozzle 24. The nozzle 24 is supplied with the ink from the print head 20. For example, 128 or 256 nozzle upper holes 24*a* may be formed. The ink may be sprayed through a lower surface of the nozzle 24 where nozzle lower holes 24*b* having a desired size are formed through the inside of the nozzle 24.

The nozzle 24 may be a silicon nozzle or a metal nozzle. In general, the nozzle 24 may be formed by using silicon through a Micro Electro Mechanical Systems (MEMS) process. As another example, the nozzle 24 may be a nozzle known in the art to adjust the ink's size, amount, etc.

The first heater H1 may be located to overlap with the ink storage 23 in a thickness direction. The first heater H1 may comprise a coil from which heat is generated in case that a current flows therein. The first heater H1 is physically in contact with the ink storage 23, and therefore heat generated from the first heater H1 may be transferred to the ink stored in the ink storage 23 by thermal conduction.

The reservoir 40 (see FIGS. 6 and 7) may store the ink and may supply the ink in response to a request of the print head 20.

Referring to FIGS. 6 and 7, the reservoir 40 may comprise an ink tank 41 and a preheating part 42. For detailed description, the ink stored in and discharged from the reservoir 40 may be divided into newly injected ink INK0 and pre-stored ink INK1. The newly injected ink INK0 is ink which is stored in an external ink storage (not shown) and then is newly injected into the ink tank 41 through an inlet 41*a*, whereas the pre-stored ink INK1 is ink that has been stored in the ink tank 41 from before the newly injected ink INK0 is injected into the ink tank 41. Therefore, a temperature of the newly injected ink INK0 may be different from that of the pre-stored ink INK1.

The ink tank 41 may comprise a storage area 41*b* which stores the pre-stored ink INK1, the inlet 41*a* through which the newly injected ink INK0 is injected into the ink tank 41 from the outside of the reservoir 40, an outlet OUT2 through which the pre-stored ink INK1 is discharged to the outside of the reservoir 40 from the storage area 41*b*, and a collection hole IN2 through which the ink that has not been discharged toward the substrate 30 from the nozzle 24 is collected. The ink tank 41 may be provided with an empty space having a constant volume to store the pre-stored ink INK1 therein. The ink tank 41 may be made of a material having high thermal conductivity. The ink tank 41 may be formed of a metal such as aluminum or an aluminum alloy.

The inlet 41*a* is formed at an upper side of the preheating part 42. Specifically, the inlet 41*a* is formed at a top surface of an edge of the ink tank 41 and may be connected to the external ink storage to allow the newly injected ink INK0 from the ink storage to be injected into the ink tank 41 therethrough.

The pre-stored ink INK1 is temporarily stored in the storage area 41*b* of the ink tank 41. A level sensor (not shown) may be disposed in the reservoir 40 to check a height of the pre-stored ink INK1 which is lowered because of discharging of the pre-stored ink INK1 and allows the newly injected ink INK0 to be injected, so that a constant amount of the newly injected ink INK0 and the pre-stored ink INK1 can be maintained and stored in the storage area 41*b*. The storage area 41*b* is defined at a lower side of the preheating part 42. Thus, the pre-stored ink INK1 may be maintained to be stored at only the lower side of the preheating part 42.

The outlet OUT2 is formed at a lower side of the preheating part 42. Specifically, the outlet OUT2 is formed at a lower side surface of the ink tank 41. However, the disclosure is not limited thereto, and the outlet OUT2 may be formed at a bottom surface of the ink tank 41. The pre-stored ink INK1 in the storage area 41*b* may reach the print head 20 through the outlet OUT2, and the pre-stored ink INK1 which has reached the print head 20 may be discharged toward the substrate 30.

One surface 41*s* of the ink tank 41 may be detachably formed. A user may detach the detachable surface 41*s* to clean the inside of the reservoir 40, in case that the inside of the reservoir 40 is contaminated, or a foreign substance is formed at the inside of the reservoir 40, due to a long-term use of the reservoir 40. However, this is merely an embodiment, and the disclosure is not limited thereto. The ink tank 41 may not comprise the detachable surface 41*s*.

The preheating part 42 is located between the inlet 41*a* and the storage area 41*b*. The newly injected ink INK0 injected into the ink tank 41 from the inlet 41*a* may reach the preheating part 42. One surface of the preheating part 42 may be in contact with an inner side surface of the ink tank 41, to be supplied with heat from the inner side surface of the ink tank 41.

The preheating part 42 may be formed of a material having high thermal conductivity. The preheating part 42 may be formed of aluminum or an aluminum alloy.

The preheating part 42 may comprise a base plate BS having a flat plate shape. The base plate BS may move the newly injected ink INK0 injected from the inlet 41*a* along a top surface thereof and may transfer the newly injected ink INK0 to the storage area 41*b*. The preheating part 42 may comprise a preheating wall WA formed along an edge of the base plate BS such that the newly injected ink INK0 is preheated, with the newly injected ink INK0 being secured on the preheating part 42 and being transferred to the storage area 41*b*. However, the disclosure is not limited thereto, and the shape of the preheating part 42 may be modified and embodied. For example, the preheating part 42 may comprise only the base plate BS without the preheating wall.

The newly injected ink INK0 may move to one end portion BS_E of the base plate BS along a top surface of the base plate BS. The newly injected ink INK0 injected through the inlet 41*a* may reach the preheating part 42. Since the preheating part 42 is in contact with the inner side surface of the ink tank 41, the preheating part 42 may be supplied with heat of the pre-stored ink INK1 transferred to the inner side surface of the ink tank 41, or vice versa, to achieve thermal equilibrium.

An initial temperature of the newly injected ink INK0 is low, and a density of the newly injected ink INK0 is high. Hence, the newly injected ink INK0 is diffused while being sunk in the preheating part 42. The sunk newly injected ink INK0 is heated by the preheating part 42, so that the temperature of the newly injected ink INK0 increases and the density of the newly injected ink INK0 decreases. The newly injected ink INK0, the temperature and density of which reach a normal state, floats and is diffused to the one end portion BS_E as indicated by a first arrow Da. The newly injected ink INK0 diffused to the one end portion BS_E moves to the storage area 41*b* from the one end portion BS_E of the base plate BS and then is joined with the pre-stored ink INK1. The preheating wall WA at the one end portion BS_E may be lower than that at another portion of the base plate BS, so that the newly injected ink INK0 may move to the storage area 41 while passing over the preheating wall WA at the one end portion BS_E as indicated by a second arrow db. However, the disclosure is not limited thereto. For example, the shape of the preheating wall WA at the one end portion BS_E may be modified and embodied.

The initial temperature of the newly injected ink INK0 which has been injected into the ink tank 41 may be a temperature lower than that of the pre-stored ink INK1. However, the newly injected ink INK0 may be preheated to a temperature equal to that of the pre-stored ink INK1, so that the temperature of the ink in the storage area 41*b* can be uniformly maintained even after the newly injected ink INK0 is joined with the pre-stored ink INK1. Thus, the viscosity of the pre-stored ink INK1 stored in the reservoir 40 is uniformly maintained, and accordingly, a uniform amount of the pre-stored ink INK1 may be discharged through the outlet OUT2.

However, the reservoir 40 may not comprise the preheating part 42 but may comprise only the storage area 41*b*.

The first pipe P1 may connect the inlet IN1 of the print head 20 to the outlet OUT2 of the reservoir 40 (see, e.g., FIG. 3).

The first pipe P1 may connect the outlet OUT2 to the inlet IN1 of the print head 20 (see, e.g., FIG. 3). The ink stored in the reservoir 40 may be supplied to the print head 20 via the first pipe P1.

The second pipe P2 may connect the outlet OUT1 of the print head 20 to the collection hole IN2 of the reservoir 40 (see, e.g., FIG. 3). The surplus ink, which has not been discharged through the nozzle 24 but remains in the reservoir 40, may be collected to the reservoir via the second pipe P2.

Referring to FIG. 8, the mixing unit 50 may be located in one area of the first pipe P1. The mixing unit 50 may comprise a static mixer SM and a second heater H2 which heats the ink.

The static mixer SM in accordance with the embodiment of the disclosure may comprise a wing 52 arranged along a length direction of a mixing tube 51. As shown in FIG. 8, the wing 52 may comprise wing-elements 53 and 54 which enable the ink to be transferred downward by changing directions of the wing-elements 53 and 54 for every pitch. The wing-elements 53 and 54 may have a screw shape, and a screw direction of the wing-element 53 and a screw direction of the wing-element 54 may be opposite to each other. However, the shape of the wing-elements 53 and 54 is not limited thereto and may be variously adjusted in response to a kind and viscosity of ink passing through the mixing unit 50. The number of wing-elements 53 and 54 may be variously adjusted in response to an amount of ink passing through the mixing unit 50.

The ink may be injected into the static mixer SM through the first pipe P1. Particles and a solvent, which are comprised in the injected ink, may be uniformly mixed with each other, as a feeding direction of the wing-elements 53 and 54 is changed for every pitch while the injected ink is passing through the wing 52 installed in the length direction of the mixing tube 51. For example, bubbles generated in the mixing process may be removed, and thus property efficiency may be improved.

The mixing unit 50 may comprise the second heater H2 surrounding the mixing tube 51 of the static mixer SM.

The second heater H2 in accordance with the embodiment of the disclosure may be a silicon rubber heater. The second heater H2 may comprise a heater mat 55 and a jacket 56.

The heater mat 55 may directly contact with and be attached to an outer surface of the mixing tube 51. Heat generated by the heater mat 55 may be directly transferred to the mixing tube 51 mainly by conduction.

The jacket 56 may be a thermal insulator which extends radially outward from the heater mat 55, substantially surrounds the heater mat 55, and has a thermal conductivity lower than that of the mixing tube 51 and the heater mat 55. Since the jacket 56 has a thermal conductivity lower than that of the mixing tube 51, the heat generated by the heater mat 55 does not flow radially outward from the mixing tube 51 but may mainly flow radially inward toward the mixing tube 51. Therefore, heat of the second heater H2 may be efficiently transferred to the ink passing through the mixing tube 51.

However, the kind of the second heater H2 is not limited thereto. For example, the second heater H2 may be an element using a Peltier effect which will be described below.

The cooling unit 60 may be located in one area of the second pipe P2 (see, e.g., FIG. 3). For example, the cooling unit 60 may be located between the pump PU and the reservoir 40.

The cooling unit 60 may cool surplus ink passing through the pump PU.

Referring to FIG. 9, the cooling unit 60 may comprise a thermoelement 61. The thermoelement 61 is an element using the Peltier effect that heat is generated or absorbed at a joint of two kinds of metals in case that a current flows through connection between the two metals. For example, because a difference in potential energy of electrons may exist between the two metals of different kinds, to transport electrons from a metal in a low-potential energy state to a metal in a high-potential energy state, it is necessary to obtain energy from the outside, and thus thermal energy is taken at a contact point, whereas to transport electrons in the opposite way, thermal energy is emitted. A direction, in which heat is generated or is absorbed, may be determined depending on a direction of current provided to the thermoelement 61.

For example, heat is absorbed at a first metal 61*a* in case that the current flows as indicated by an arrow direction shown in FIG. 9, and heat is emitted at a second metal 61*b*. Heat is emitted at the first metal 61*a* in case that the current flows in the opposite direction to the arrow direction shown in FIG. 9, and heat is absorbed at the second metal 61*b*.

Thus, in the disclosure, the overall space efficiency may improve because in order to lower the temperature of the surplus ink passing through the second pipe P2, relatively small mounting space is required as the thermoelement 61, which provides a cooling effect in case that a current is applied, is used instead of a fan-type cooler, which requires a large space.

The thermoelement 61 may be located to surround the second pipe P2. In case that the cooling unit 60 senses that the temperature of surplus ink passing through the second pipe P2 increases through a temperature sensor (not shown), the sensing unit 60 enables heat to be rapidly emitted through the thermoelement 61. The cooling unit 60 may control an operation of the thermoelement 61 through an independent controller (not shown) or may control an operation of the thermoelement 61 through the controller 70, which will be described below.

For example, the cooling unit 60 may maintain the temperature of surplus ink passing through the second pipe P2 to be equal to an atmospheric temperature (e.g., about 23° C.). In other words, the cooling unit 60 may maintain the temperature of surplus ink collected to the reservoir 40 to be equal to a temperature in case that the ink was initially supplied to the print head 20 from the reservoir 40.

For example, the temperature of ink initially stored in the reservoir 40 may have an atmospheric temperature (or ambient temperature of the inkjet print apparatus) since the ink has not yet been circulated through the inkjet print apparatus. Therefore, in case that the temperature of surplus ink is maintained to be equal to the atmospheric temperature, the temperature of surplus ink collected through the collection hole of the reservoir 40 may be equal to the temperature of the ink in case that the ink was initially supplied to the print head 20 from the reservoir 40.

Therefore, the surplus ink collected to the reservoir 40 may maintain its property such as the temperature and viscosity to be similar or identical to those of the newly injected ink INK0 injected from the external ink storage (not shown).

However, the cooling unit 60 is not limited to the thermoelement 61. For example, the temperature of surplus ink passing through the second pipe P2 may be constantly maintained by allowing a coolant or cooling water to always flow in the second pipe P2.

The pump PU may be located in one area of the second pipe P2. For example, the pump PU may be located between the print head 20 and the cooling unit 60.

The pump PU (see, e.g., FIG. 3) may pressurize surplus ink and supply the pressurized surplus ink to the reservoir 40. The surplus ink passing through the pump PU has not yet passes through the cooling unit 60, and therefore, the surplus ink may have a viscosity lower than that of the surplus ink that has passed through the cooling unit 60. Thus, since the surplus ink having the low viscosity is supplied to the reservoir 40 by the pump PU, the durability and operation performance of the pump PU can be improved.

The temperature sensor TS may be located in one area of the first pipe P1. For example, the temperature sensor TS may be located between the mixing unit 50 and the inlet IN1 of the print head 20. The temperature sensor may sense a temperature of ink passing through the mixing unit 50.

The controller 70 may control a temperature of the first heater H1 and/or the second heater H2 in response to information received from the temperature sensor TS.

For example, the controller 70 may increase a temperature of ink passing through the mixing unit 50, through the second heater H2, so as to constantly maintain an amount of ink discharged from the print head 20. However, in case that a length of the first pipe P1 from the mixing unit 50 to the print head 20 is long, the temperature of ink heated by the second heater H2 may again decrease. In case that an intended temperature of ink is changed due to an external environment, the print quality of the inkjet print apparatus 1 may be deteriorated.

Therefore, in case that it is determined that a temperature of ink, which is sensed by the temperature sensor TS, is different from that of ink heated by the second heater H2, the controller 70 may maintain, through the first heater, the temperature of ink stored in the ink storage 23 to be equal to the temperature of ink heated by the second heater H2.

Hereinafter, other embodiments will be described. In the following embodiments, descriptions of components identical to those of the above-described embodiment may be omitted or simplified, and portions different from those of the above-described will be mainly described.

Figure 10:
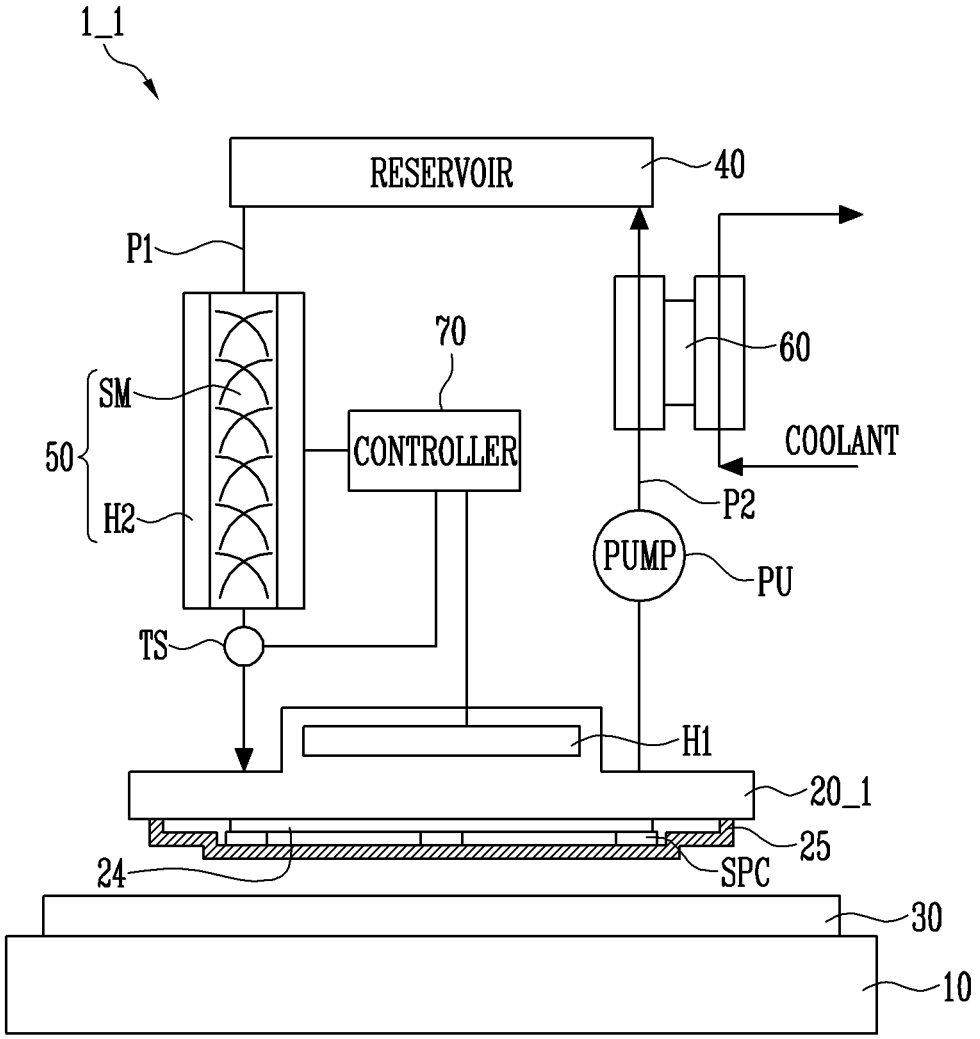
FIG. 10 is a view schematically illustrating an inkjet print apparatus in accordance with an embodiment of the disclosure.
Figure 11:
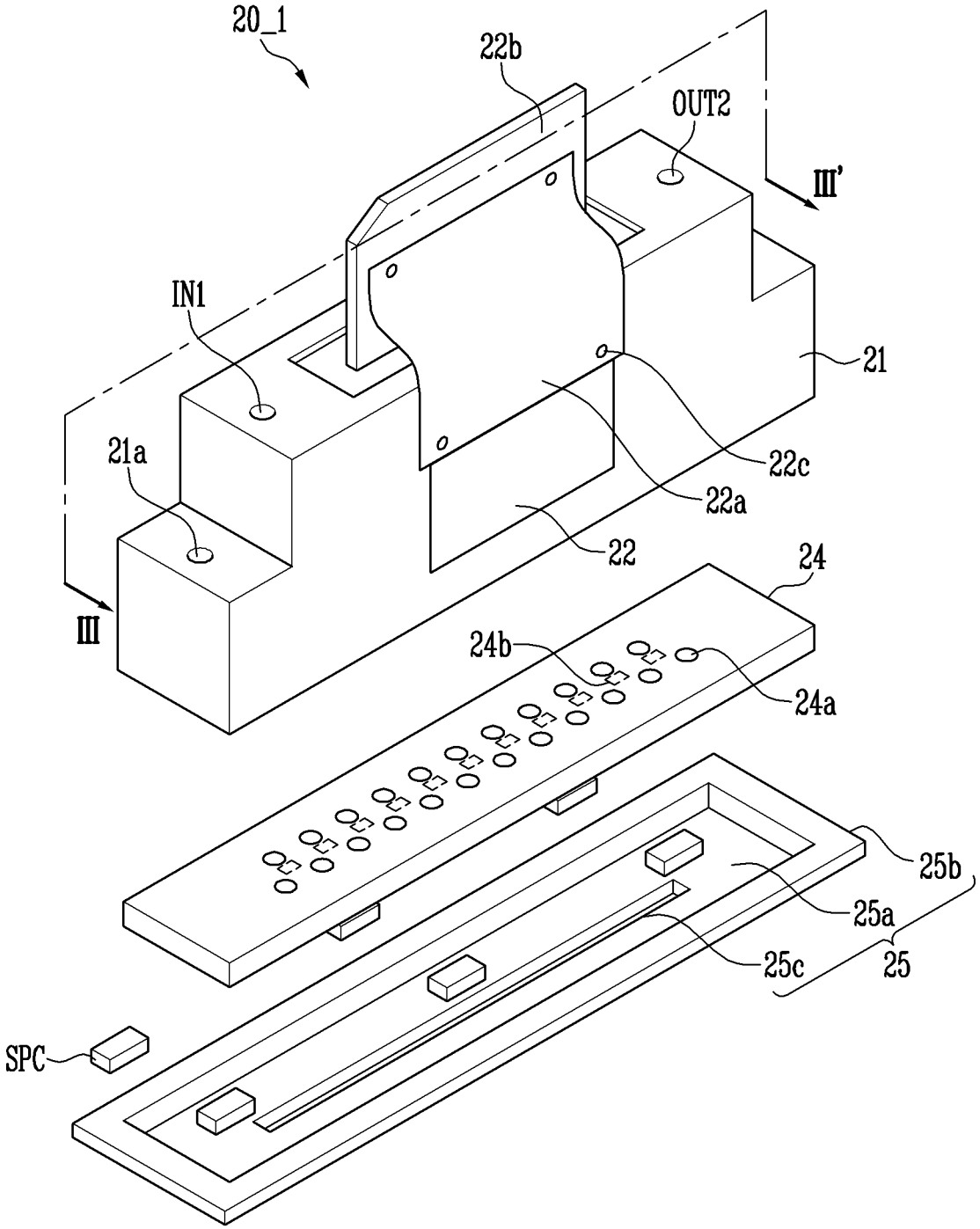
FIG. 11 is a schematic perspective view of a print head in accordance with an embodiment of the disclosure.
Figure 12:
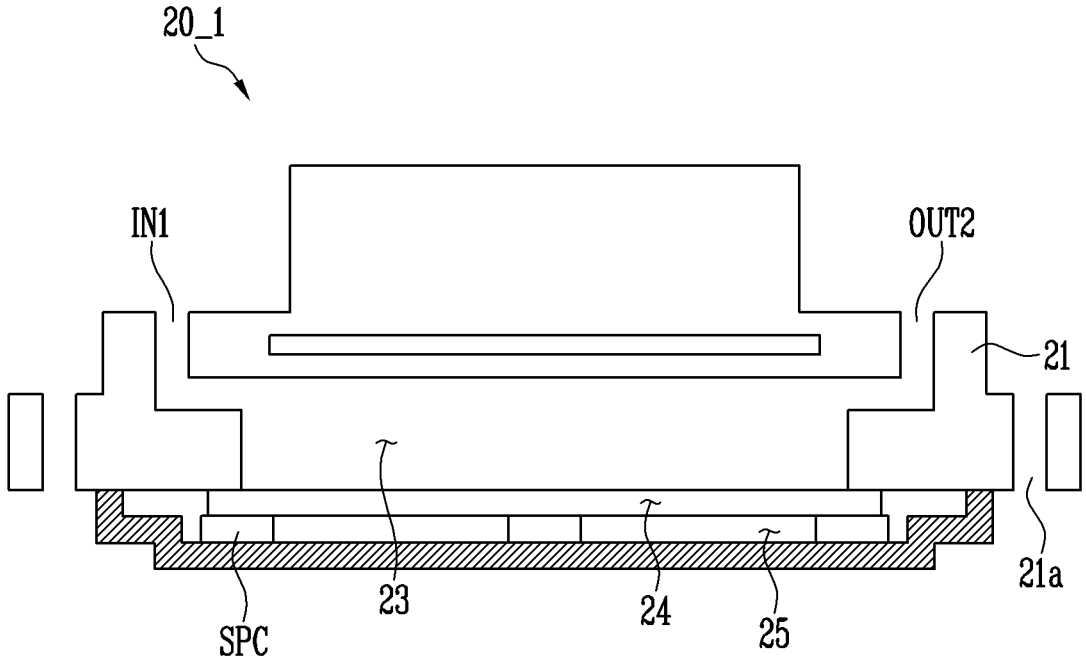
FIG. 12 is a schematic sectional view of the print head taken along line shown in FIG. 11.

FIG. 10 is a view schematically illustrating an inkjet print apparatus in accordance with an embodiment of the disclosure. FIG. 11 is a schematic perspective view of a print head in accordance with an embodiment of the disclosure. FIG. 12 is a cross-schematic sectional view of the print head taken along line shown in FIG. 11.

Referring to FIGS. 10 to 12, the inkjet print apparatus 1_1 in accordance with an embodiment of the disclosure is different from the inkjet print apparatus 1 shown in FIG. 3, in that the inkjet print apparatus 1_1 further comprises a heat insulator 25 which blocks heat emitted from a first heater H1 between a substrate 30 and the first heater H1. Therefore, descriptions of a reservoir 40, a mixing unit 50, a cooling unit 60, the first pipe P1, a second pipe P2, and a pump PU, which may have substantially identical configurations and operations, will be omitted, and a print head 20_1 will be described hereinbelow.

Specifically, the print head 20_1 may further comprise the heat insulator 25 which blocks heat emitted from the first heater H1 between the substrate 30 and the first heater H1.

The heat insulator 25 may be located on a bottom surface of a main body. A nozzle 24 may be located between the heat insulator 25 and the main body 21. The heat insulator 25 may be located to be spaced apart from the nozzle 24 at a certain distance. For example, the heat insulator 25 and the nozzle 24 may be supported by spacers SPC.

The heat insulator 25 may be integrally formed to surround the nozzle 24. For example, as shown in FIG. 11, the heat insulator 25 may comprise an accommodation part 25*a* having a rectangular parallelepiped shape and a fastening part 25*b* for fastening the accommodation part 25*a* to the bottom surface of the main body 21. An opening 25*c* overlapping the nozzle 25 (or nozzle lower holes 24) in a thickness direction may be formed at a bottom surface of the accommodation part 25*a*.

The heat insulator 25 may have an emissivity of about 0.2 or less. The emissivity refers to a ratio of energy re-emitted in case that an object absorbs external light energy and then allows a portion of the light energy to be transmitted therethrough or in case that a surface reflection phenomenon occurs. Theoretically, an object that absorbs external energy and then emits 100% of the energy but does not perform surface reflection is referred to as a blackbody. The emissivity of the blackbody may be defined as 1. That is, in case that the emissivity is about 0.2, only about 20% of heat emitted from the first heater H1 is re-emitted. In other word, in case that the emissivity is about 0.2, this may mean that about 80% of heat emitted from the first heater H1 is surface-reflected or partially transmitted. For example, the heat insulator 25 may comprise any one of stainless steel (SUS), gold (Au), silver (Ag), copper (Cu), and aluminum (Al). In accordance with an embodiment of the disclosure, the spacer SPC and the above-described heat insulator 25 may comprise a same material.

A controller 70 may control a temperature of ink through the first heater H1, to constantly maintain a discharge amount of the ink. However, the temperature of the ink heated through the first heater H1 may be generally higher than the atmospheric temperature (e.g., about 23° C.). For example, heat emitted by the first heater H1 may be about 40° C.

The heat emitted by the first heater H1 may be transferred to the substrate 30. A non-uniform temperature distribution may occur on one surface of the substrate 30, which faces the first heater H1. In case that the non-uniform temperature distribution occurs on the substrate 30, the flatness of the substrate 30 may be changed due to thermal expansion, and therefore, the print quality of the inkjet print apparatus 1_1 may be deteriorated.

The print head 20_1 in accordance with the embodiment of the disclosure comprises the heat insulator 25, so that the temperature distribution on the substrate 30 may be uniformly maintained by blocking heat transferred onto the substrate 30. Further, as the heat emitted from the first heater H1 to the outside is reduced, a decrease in the temperature of ink stored in an ink storage 23 may be prevented.

Figure 13:
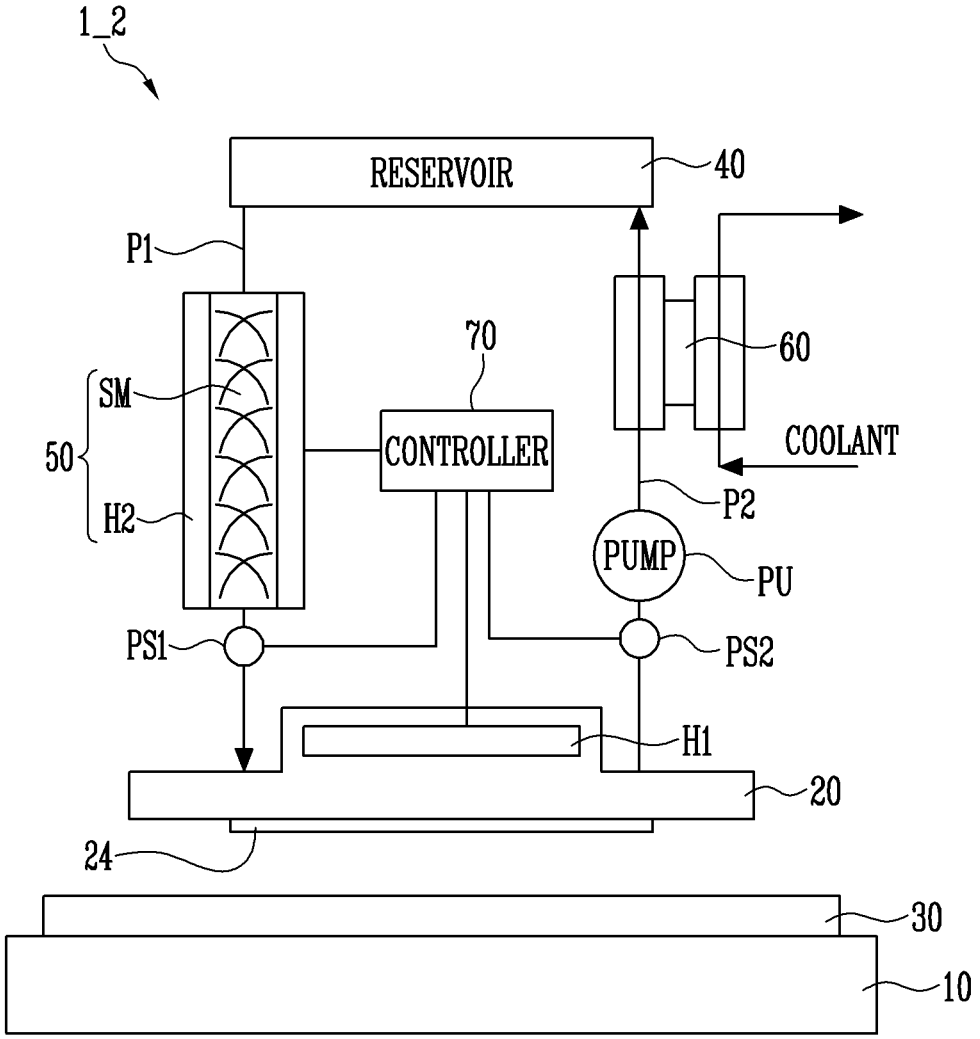
FIGS. 13 to 16 are views schematically illustrating inkjet print apparatuses in accordance with embodiments of the disclosure.

FIG. 13 is a view schematically illustrating an inkjet print apparatus in accordance with another embodiment of the disclosure.

Referring to FIG. 13, the inkjet print apparatus 1_2 in accordance with an embodiment of the disclosure is different from the inkjet print apparatus 1 shown in FIG. 3, in that the inkjet print apparatus 1_2 comprises pressure sensors PS1 and PS2. Therefore, descriptions of a reservoir 40, a mixing unit 50, a cooling unit 60, a first pipe P1, a second pipe P2, and a pump PU, which have substantially identical configurations and operations, may be omitted, and the pressure sensors PS1 and PS2 will be described hereinbelow.

Specifically, a first pressure sensor PS1 may be located on the first pipe P1 between the mixing unit 50 and a print head 20. The first pressure sensor PS1 may sense a pressure of ink after passing through the mixing unit 50 and before being introduced to the print head 20.

In case that the pressure sensed by the first pressure sensor PS1 is higher than a predetermined pressure, a controller 70 may heat the ink to a predetermined temperature corresponding to the sensed pressure.

in case that ink is repeatedly circulated, a concentration of the ink may be changed depending on the volatilization of a solvent comprised in the ink. In case that ink is repeatedly heated and cooled, a physical property of the ink may be changed. Although the ink having the changed property is heated to the same temperature as that of the newly injected ink INK0 (see FIGS. 6 and 7) injected into the ink tank 41, the ink and the newly injected ink INK0 may have different viscosities.

A pressure loss in the first pipe P1 may have a relationship with viscosity as shown in the following Equation 1.

Pressure loss=*a**viscosity*pipe length*average flow rate/pipe internal diameter (*a* is a proportional constant) Equation 1

For example, in case that the viscosity of ink increases, the resistance of the ink passing through a nozzle 24 increases, and therefore, a pressure value sensed by the first pressure sensor PS1 may increase. The controller 70 may heat the ink to a predetermined temperature corresponding to the sensed pressure value through the first heater H1. A relationship between the viscosity and temperature of the ink may be experimentally obtained, and a lookup table may be generated in advance based on their relationship. In accordance with an embodiment, the predetermined temperature may become higher as the sensed pressure value become higher. Thus, in case that the viscosity of the ink increases, the viscosity of the ink decreases by heating the ink to a higher temperature through the first heater H1. Accordingly, the viscosity of the ink may be constantly maintained.

Thus, although a property of the ink is changed, the viscosity of the ink is constantly maintained, so that the discharge amount of the ink may be uniformly maintained.

A second pressure sensor PS2 may be located on the second pipe P2 between the print head 20 and the pump PU. The second pressure sensor PS2 may sense a pressure of ink after the ink passes through the print head 20 and before the ink is introduced to the pump PU.

In case that a difference between the pressure sensed by the first pressure sensor PS1 and the pressure sensed by the second pressure sensor PS2 exceeds a predetermined range, the controller 70 may heat the ink in proportion to the difference between the pressures through the first heater H1.

For example, in case that the viscosity of the ink increases, the resistance of the ink passing through the nozzle 24 increases. Therefore, the pressure value sensed by the first pressure sensor PS1 may increase, and a difference between the pressure value sensed by the first pressure sensor PS1 and a pressure value sensed by the second pressure sensor PS2 may also increase. The ink may be heated in proportion to the difference between the pressures through the first heater H1. For example, the ink may be heated to a higher temperature through the first heater H1 as the difference between the pressures becomes larger.

A relationship between viscosity and temperature of the ink may be experimentally obtained, and a lookup table may be generated in advance based on their relationship.

Accordingly, although a property of the ink is changed, the viscosity of the ink is constantly maintained, so that the discharge amount of the ink may be uniformly maintained. Although an embodiment without the temperature sensor has been described in FIG. 13, the pressure sensors PS1 and PS2 and the temperature sensor may be applied together.

Figure 14:
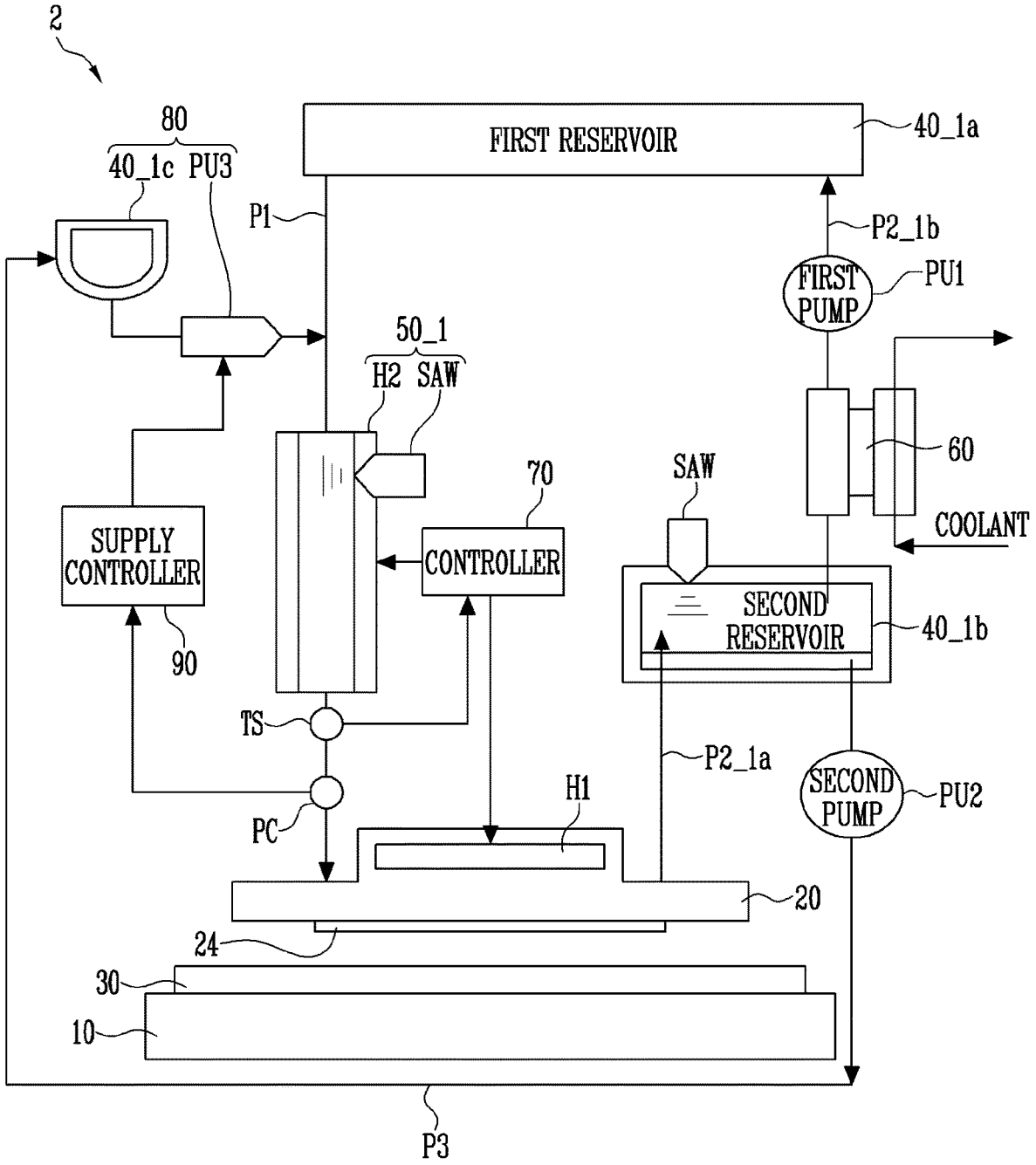

FIG. 14 is a view schematically illustrating an inkjet print apparatus in accordance with an embodiment of the disclosure.

Referring to FIG. 14, the inkjet print apparatus 2 is different from the inkjet print apparatus 1 shown in FIG. 1, in that the inkjet print apparatus 2 separately supplies a particle-containing solution and a solvent, which are comprised in the ink, to a print head 20. The particle-containing solution comprised in the ink may comprise an inorganic material.

Specifically, the inkjet print apparatus 2 may be divided into a solvent circulating unit which supplies a solvent comprised in ink and a particle circulating unit which supplies a particle-containing solution comprised in the ink.

The solvent circulating unit may comprise a first reservoir 40_1*a* which stores a solvent, a first pipe P1 which supplies the solvent from the first reservoir 40_1*a* to the print head 20, a mixing unit 50_1 which is located on the first pipe P1 and mixes the solvent supplied from the first reservoir 40_1*a* with a particle-containing solution of ink supplied from a particle supply unit 80 which will be described below, a second pipe P2_1*a* which supplies, to a second reservoir 40_1*b*, a surplus ink which has not been discharged from the print head 20 and then remains, a second pipe P2_1*b* which collects, to the first reservoir 40_1*a*, a surplus solvent separated from the ink by the second reservoir 40_1*b*, and a cooling unit 60 located on the second pipe P2_1*b*.

The first reservoir 40_1*a* corresponds to the reservoir 40 shown in FIG. 3, a first pump PU1 corresponds to the pump PU shown in FIG. 3, and the print head 20, a temperature sensor TS, and the cooling unit 60 have configurations and operations that are substantially identical to those of the embodiment shown in FIG. 3. Therefore, the mixing unit 50_1 will be described hereinbelow.

As shown in FIG. 14, the mixing unit 50_1 may uniformly mix a particle-containing solution and a solvent, which are comprised in the ink, through a mixer SAW using a surface acoustic wave. The surface acoustic wave is a kind of ultrasonic wave and has a characteristic in which the wave energy of the surface acoustic wave is transmitted while concentrating on the surface of a spherical body.

The particle circulating unit may comprise the particle supply unit 80 which supplies a particle-containing solution of ink to the first pipe P1 between the first reservoir 40_1*a* and the mixing unit 50_1, the second reservoir 40_1*b* which is located in one area of the second pipes P2_1*a* and P2_1*b*, and stores surplus ink which has not been discharged from the print head 20 and then remains, a third pipe P3 which collects, to the particle supply unit 80, a surplus particle-containing solution separated from a surplus solvent in the surplus ink, from the second reservoir 40_1*b*, a concentration sensor PC which is located on the first pipe P1 between the particle supply unit 80 and the print head 20, and senses a concentration of particles, and a supply controller 90 which controls a supply amount of the particle-containing solution in response to information received from the concentration sensor PC. A third reservoir 40_1*c* may have a configuration and an operation that are identical to those of the reservoir 40 shown in FIG. 3. Hereinafter, the particle supply unit 80, the concentration sensor PC, and the second reservoir 40_1*b* will be mainly described.

The second reservoir 40_1*b* may separate surplus ink that has not been discharged from the print head 20 and is collected therefrom into a surplus solvent and a surplus particle-containing solution, by using a surface acoustic wave.

A second pump PU2 may be located on the third pipe P3 between the second reservoir 40_1*b* and the particle supply unit 80 and may pressurize the surplus particle-containing solution separated from the surplus ink and then supply the surplus particle-containing solution to the particle supply unit 80.

The particle supply unit 80 may comprise the third reservoir 40_1*c*, which stores the collected surplus particle-containing solution, and a third pump PU3, which supplies the surplus particle-containing solution to the first pipe P1 in an area between the first reservoir 40_1*a* and the mixing unit 50_1 from the third reservoir 40_1*c*.

The concentration sensor PC in accordance with the embodiment of the disclosure may be a particle counter which counts a number of particles per unit volume, which are comprised in the ink.

In case that a concentration of particles comprised in the ink, which is sensed by the concentration sensor PC, is lower than a predetermined concentration, the supply controller 90 may increase a supply amount of the particle-containing solution through the third pump PU3.

In case that a particle-containing solution including an inorganic material is comprised in the ink, there may occur a case where a particle is separated from a solvent and then precipitated due to the size and weight of the particle. In particular, in case that a length of the first pipe P1 located between the mixing unit 50_1 and the print head 20 is long, the particle may be separated from the solvent and then precipitated while the mixed ink is reaching the print head 20. The concentration of the ink discharged from the print head 20 becomes non-uniform, and therefore, the print quality of the inkjet print apparatus 2 may be deteriorated.

The inkjet print apparatus 2 in accordance with the embodiment of the disclosure senses a concentration of ink in the vicinity of an inlet of the print head 20 through the concentration sensor PC, and controls the concentration of the ink to be constant through the supply controller 90, so that the concentration of the ink discharged from the print head 20 can be uniformly maintained. Further, the solvent circulating unit and the particle circulating unit are separately operated, so that an overall load applied to the inkjet print apparatus 2 can be lowered.

Figure 15:
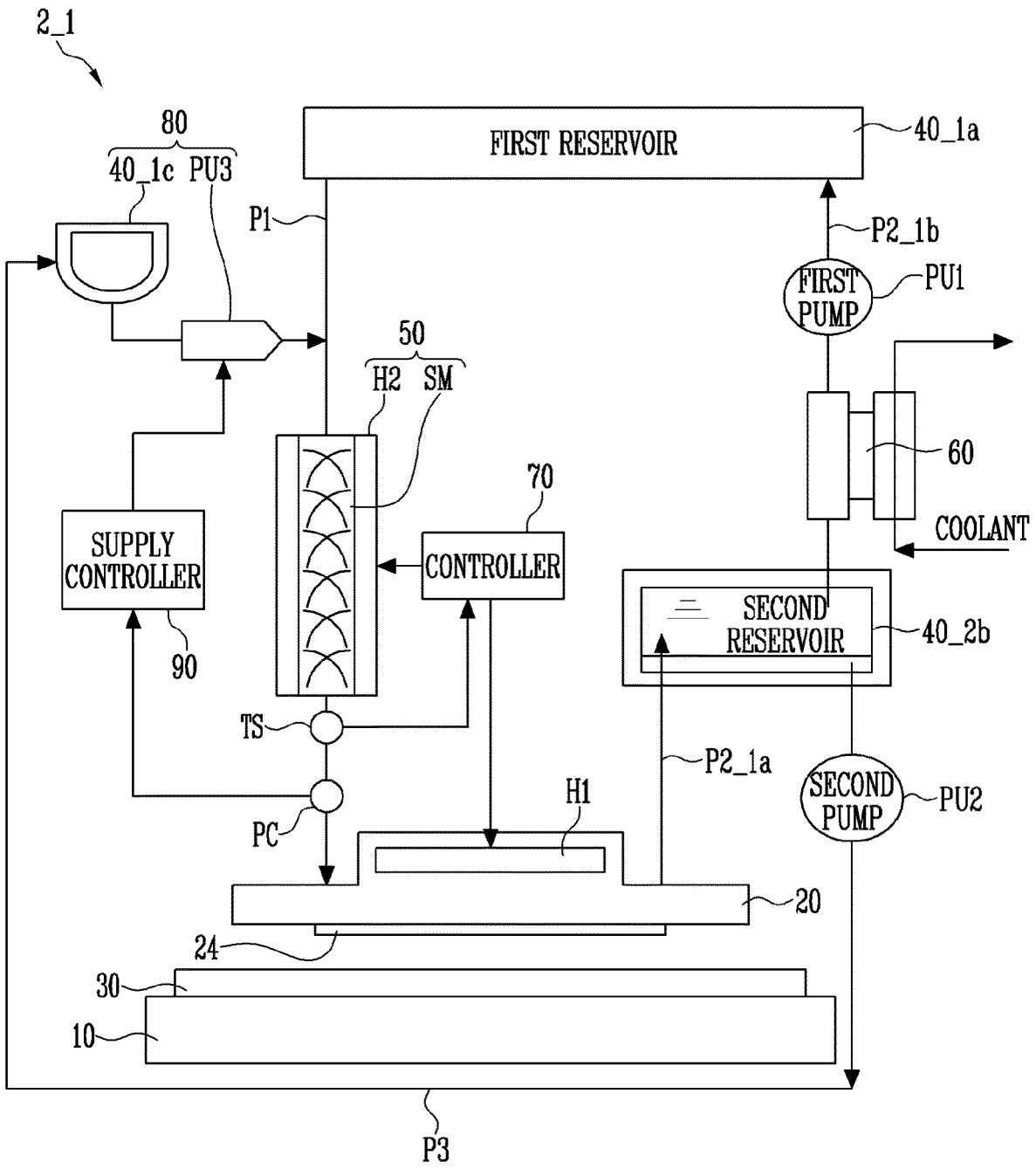

FIG. 15 is a view schematically illustrating an inkjet print apparatus in accordance with another embodiment of the disclosure.

Referring to FIG. 15, the inkjet print apparatus 2_1 is different from the embodiment shown in FIG. 14, at least in that a mixing unit 50 comprises a static mixer SM instead of a mixer SAW using a surface acoustic wave and that a particle-containing solution and a solvent are separated not by using a surface acoustic wave but by using gravity in a second reservoir 40_2*b*.

The static mixer SM has been described with reference to FIG. 3, and therefore, overlapping descriptions may be omitted. The second reservoir 40_2*b* will be described below. The second reservoir 40_2*b* does not allow surplus ink collected from a print head 20 to be discharged to a cooling unit 60 and a second pipe P2 and may store the surplus ink for a certain time. Particles comprised in the ink may be precipitated by gravity.

Since a device for generating a surface acoustic wave is not required in the second reservoir 40_2*b*, the inkjet print apparatus 2_1 may be lightweight and has an advantage in terms of cost.

Figure 16:
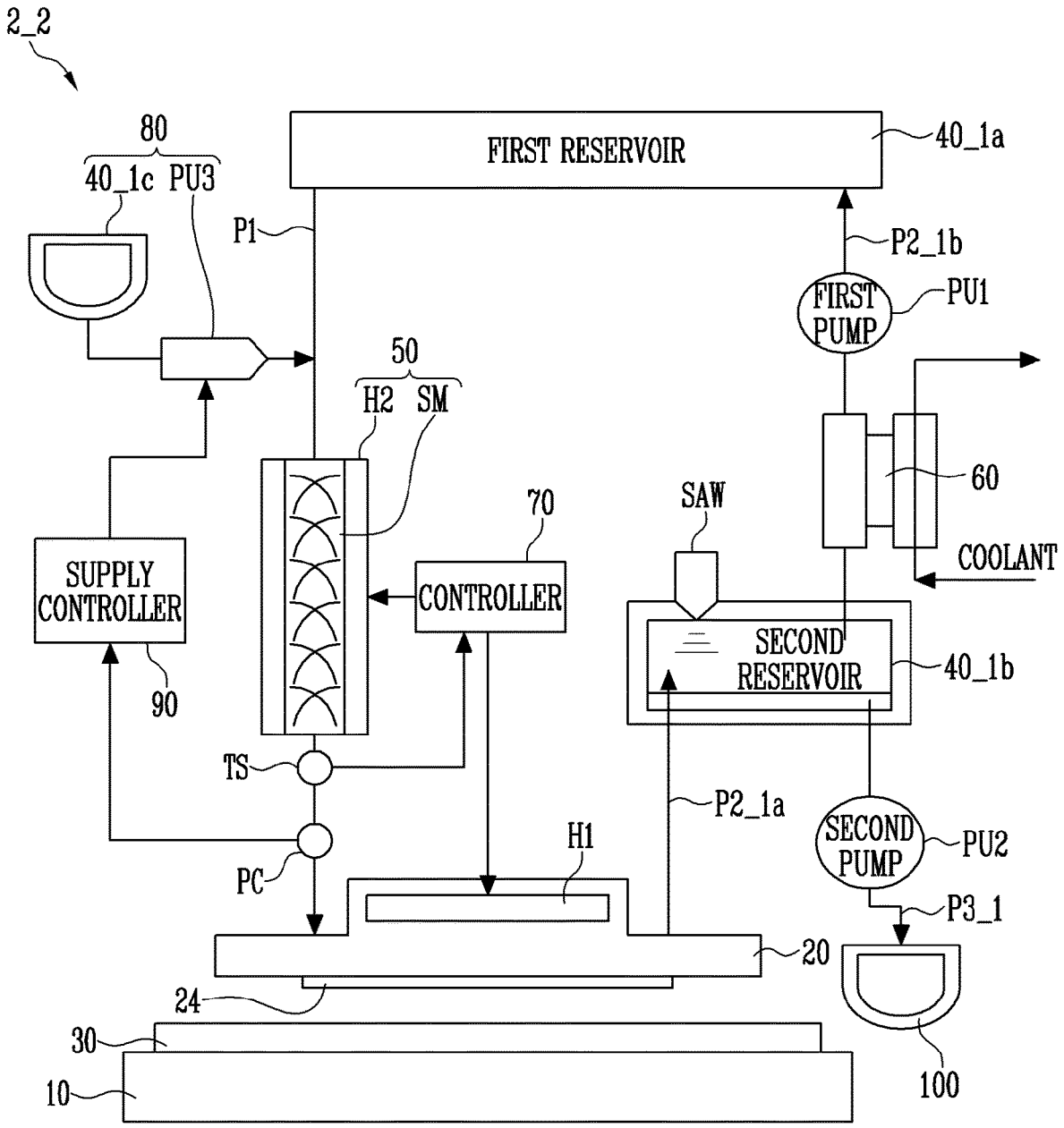

FIG. 16 is a view schematically illustrating an inkjet print apparatus in accordance with an embodiment of the disclosure.

Referring to FIG. 16, the inkjet print apparatus 2_2 is different from the embodiment shown in FIG. 14 at least in that the inkjet print apparatus 2_2 does not comprise the third pipe P3 connecting the second pump P2 and the particle supply unit 80 but comprises a particle collection unit 100.

Specifically, a second reservoir 40_1*b* may separate a surplus ink, which has not been discharged from the print head 20 and is collected, into a surplus solvent and a surplus particle-containing solution, by using a surface acoustic wave. A second pump PU2 may be located on a third pipe P3_1 between the second reservoir 40_1*b* and the particle collection unit 100 and may supply the surplus particle-containing solution separated from the surplus ink to the particle collection unit 100.

Upon checking the state of the surplus particle-containing solution collected to the particle collection unit 100, if the state of the surplus particle-containing solution collected to the particle collection unit 100 is satisfactory, the surplus particle-containing solution may be supplied to a particle supply unit 80; otherwise, the surplus particle-containing solution may be discarded. Accordingly, the property the ink may be maintained in a satisfactory state.

In the inkjet print apparatus in accordance with the disclosure, the discharge amount of ink may be maintained by uniformly maintaining the temperature and viscosity of the ink.

In the inkjet print apparatus in accordance with the disclosure, the heat generated from the print head may be prevented from being transferred to the substrate, so that a thin film having a pattern may be printed at a desired position on the substrate by uniformly maintaining the temperature distribution of the substrate.

In the inkjet print apparatus in accordance with the disclosure, the precipitation of a particle comprised in the ink is prevented, so that the concentration of the ink may be uniformly maintained.

Some embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with an embodiment may be used alone or in combination with features, characteristics, and/or elements described in connection with other embodiments unless otherwise specifically indicated. Accordingly, it will be understood by those of skill in the art that various changes in form and details may be made without departing from the spirit and scope of the disclosure.

What is claimed is:

1. An inkjet print apparatus comprising:

a print head discharging ink onto a substrate, the print head including a first heater heating the ink;

a reservoir storing the ink;

a first pipe supplying the ink to the reservoir from the print head;

a second pipe collecting surplus ink to the reservoir from the print head;

a mixing unit located on the first pipe, the mixing unit including a second heater heating the ink, the mixing unit mixing the ink;

a pump located on the second pipe, the pump pressurizing the surplus ink and supplying the surplus ink to the reservoir;

a temperature sensor located on the first pipe between the mixing unit and the print head, the temperature sensor sensing a temperature of the ink; and a controller controlling a temperature of at least one of the first heater and the second heater in response to information received from the temperature sensor, wherein the print head comprises a heat insulator blocking heat emitted from the first heater between the substrate and the first heater.

2. The inkjet print apparatus of claim 1, wherein:

the print head comprises a nozzle discharging the ink, and the heat insulator comprises an opening overlapping the nozzle in a thickness direction.

3. The inkjet print apparatus of claim 1, further comprising a cooling unit located on the second pipe between the pump and the reservoir, the cooling unit cooling the surplus ink.

4. The inkjet print apparatus of claim 3, wherein the cooling unit comprises a thermoelement.

5. The inkjet print apparatus of claim 3, wherein the cooling unit maintains a temperature of the surplus ink to be equal to a temperature of the ink initially supplied to the print head from the reservoir.

6. The inkjet print apparatus of claim 1, wherein the controller maintains a temperature of the print head to be equal to that of the ink heated by the second heater, through the first heater.

7. The inkjet print apparatus of claim 1, wherein the second heater comprises a thermoelement or a silicon rubber heater.

8. The inkjet print apparatus of claim 1, wherein the mixing unit comprises a static mixer or a mixer using a surface acoustic wave (SAW).

9. An inkjet print apparatus comprising:

a print head discharging ink onto a substrate, the print head including a first heater heating the ink;

a reservoir storing the ink;

a first pipe supplying the ink to the reservoir from the print head;

a second pipe collecting surplus ink to the reservoir from the print head;

a mixing unit located on the first pipe, the mixing unit including a second heater heating the ink, the mixing unit mixing the ink;

a pump located on the second pipe, the pump pressurizing the surplus ink and supplying the surplus ink to the reservoir;

a temperature sensor located on the first pipe between the mixing unit and the print head, the temperature sensor sensing a temperature of the ink;

a first pressure sensor located on the first pipe between the mixing unit and the print head, the first pressure sensor sensing a pressure of the ink; and a controller controlling a temperature of at least one of the first heater and the second heater in response to information received from the temperature sensor, wherein the print head comprises a heat insulator blocking heat emitted from the first heater between the substrate and the first heater.

10. The inkjet print apparatus of claim 9, wherein, in case that the pressure sensed by the first pressure sensor is higher than a predetermined pressure, the controller heats the ink to a predetermined temperature corresponding to the sensed pressure, through the first heater.

11. The inkjet print apparatus of claim 9, further comprising a second pressure sensor located on the second pipe between the print head and the pump, the second pressure sensor sensing a pressure of the surplus ink.

12. The inkjet print apparatus of claim 11, wherein, in case that a difference between the pressure sensed by the first pressure sensor and the pressure sensed by the second pressure sensor exceeds a predetermined range, the controller heats the ink in proportion to the difference between the pressures, through the first heater.

13. An inkjet print apparatus comprising:

a print head discharging ink;

a solvent circulating unit supplying a solvent comprised in the ink to the print head; and a particle circulating unit supplying a particle-containing solution comprised in the ink to the print head, wherein the solvent circulating unit comprises:

a first reservoir storing the solvent;

a first pipe supplying the solvent to the print head from the first reservoir; and a second pipe collecting a surplus solvent comprised in surplus ink to the first reservoir from the print head, wherein the particle circulating unit comprises:

a particle supply unit supplying the particle-containing solution to the first pipe;

a second reservoir located on the second pipe, the second reservoir storing the surplus ink;

a third pipe collecting a surplus particle-containing solution separated from the surplus solvent of the surplus ink to the particle supply unit from the second reservoir;

a concentration sensor located on the first pipe between the particle supply unit and the print head, the concentration sensor sensing a concentration of the ink; and a supply controller controlling a supply amount of the particle-containing solution in response to information received from the concentration sensor.

14. The inkjet print apparatus of claim 13, wherein the particle supply unit comprises:

a third reservoir storing the collected surplus particle-containing solution; and a first pump supplying the surplus particle-containing solution to the first pipe from the third reservoir.

15. The inkjet print apparatus of claim 13, wherein, in case that the concentration of the ink, which is sensed by the concentration sensor, is lower than a predetermined concentration, the supply controller increases the supply amount of the particle-containing solution through the first pump.

16. The inkjet print apparatus of claim 13, further comprising a second pump located on the third pipe, the second pump pressurizing the surplus particle-containing solution and supplying the surplus particle-containing solution to the particle supply unit.

17. The inkjet print apparatus of claim 13, wherein the second reservoir separates the surplus ink into the surplus solvent and the surplus particle-containing solution by using a surface acoustic wave (SAW).

18. The inkjet print apparatus of claim 13, wherein the print head comprises a first heater heating the ink.

19. The inkjet print apparatus of claim 18, further comprising a mixing unit located on the first pipe between the particle supply unit and the concentration sensor, wherein the mixing unit comprises a second heater heating the ink and mixes the solvent and the particle-containing solution.

20. The inkjet print apparatus of claim 19, further comprising a temperature sensor located on the first pipe between the mixing unit and the print head, the temperature sensor sensing a temperature of the ink.

21. The inkjet print apparatus of claim 19, comprising a controller controlling a temperature of the print head to be equal to that of the ink heated by the second heater, through the first heater.

22. The inkjet print apparatus of claim 19, wherein the mixing unit comprises a static mixer or a mixer using a surface acoustic wave (SAW).

23. The inkjet print apparatus of claim 13, further comprising a cooling unit located on the second pipe between the second reservoir and the third reservoir, the cooling unit cooling the surplus solvent.

24. The inkjet print apparatus of claim 23, wherein the cooling unit maintains a temperature of the surplus solvent to be equal to a temperature of the solvent initially supplied to the print head from the first reservoir.

* * * * *